US007823218B2

(12) United States Patent
Goyer et al.

(10) Patent No.: US 7,823,218 B2
(45) Date of Patent: Nov. 2, 2010

(54) PROTECTIVE PADS HAVING CUSTOMIZABLE FLEXIBILITY

(75) Inventors: Greg Goyer, Point Claire (CA); Matt Eggink, St. Lazare (CA)

(73) Assignee: Mission Itech Hockey, Inc., Irvine, CA (US)

( * ) Notice: Subject to any disclaimer, the term of this patent is extended or adjusted under 35 U.S.C. 154(b) by 95 days.

(21) Appl. No.: 12/037,891

(22) Filed: Feb. 26, 2008

(65) Prior Publication Data

US 2008/0201814 A1 Aug. 28, 2008

Related U.S. Application Data

(60) Provisional application No. 60/903,465, filed on Feb. 26, 2007.

(51) Int. Cl.
*A41D 13/00* (2006.01)

(52) U.S. Cl. ..... 2/22

(58) Field of Classification Search ..... 2/16, 2/22, 24, 62, 911

See application file for complete search history.

(56) References Cited

U.S. PATENT DOCUMENTS

| | | | | | |
|---|---|---|---|---|---|
| 4,250,578 | A | * | 2/1981 | Barlow | 2/24 |
| 4,868,926 | A | * | 9/1989 | Lowson | 2/22 |
| 5,093,931 | A | * | 3/1992 | LaBerge et al. | 2/22 |
| 5,328,652 | A | * | 7/1994 | Thomson | 264/51 |
| 6,065,152 | A | * | 5/2000 | Parker | 2/22 |

* cited by examiner

*Primary Examiner*—Tejash Patel
(74) *Attorney, Agent, or Firm*—Knobbe, Martens, Olson & Bear, LLP

(57) ABSTRACT

A protective padding system is provided in which a padding member has one or more cavities formed therein. The padding member preferentially flexes at the cavities. An insert is adapted to selectively engage and fit into the cavity. When engaged, the insert reinforces the padding member at the cavity, and thus reduces or eliminates the flexibility of the padding member at that location. By selectively engaging or disengaging an insert, a user may customize the flexibility characteristics of the padding member in a reversible manner.

13 Claims, 15 Drawing Sheets

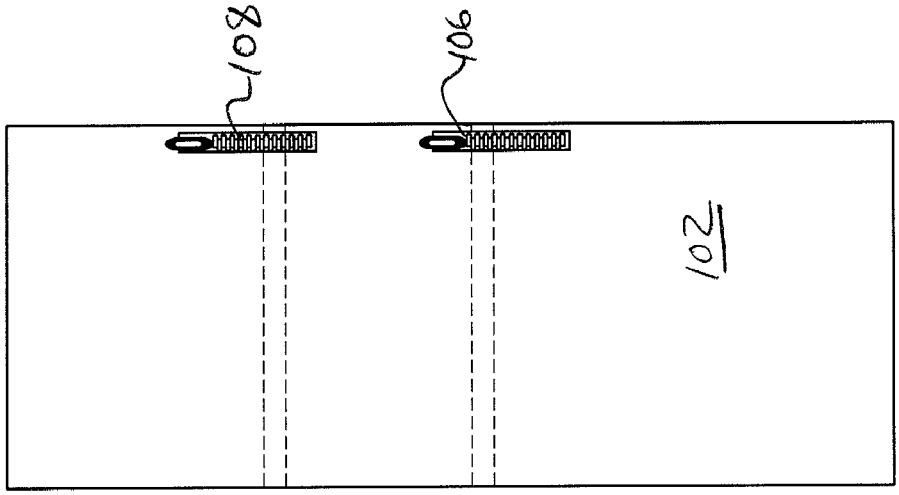
FIG. 9
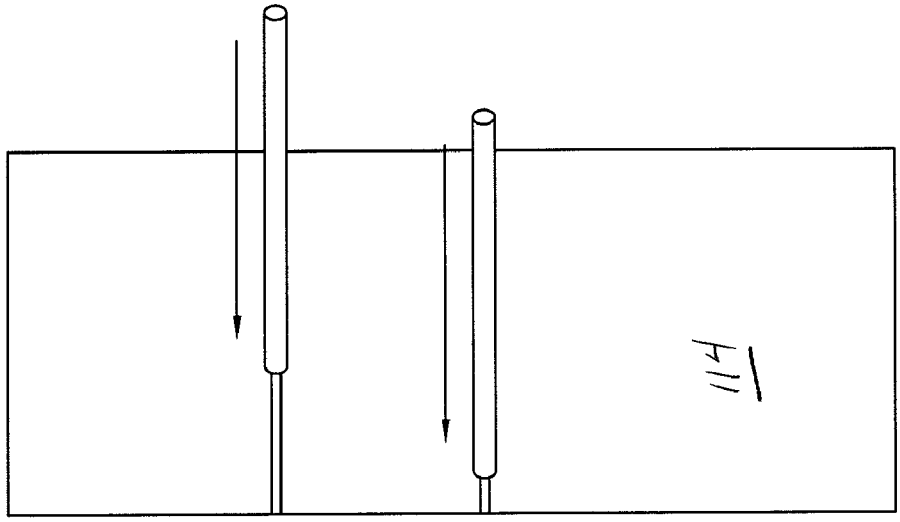
FIG. 8
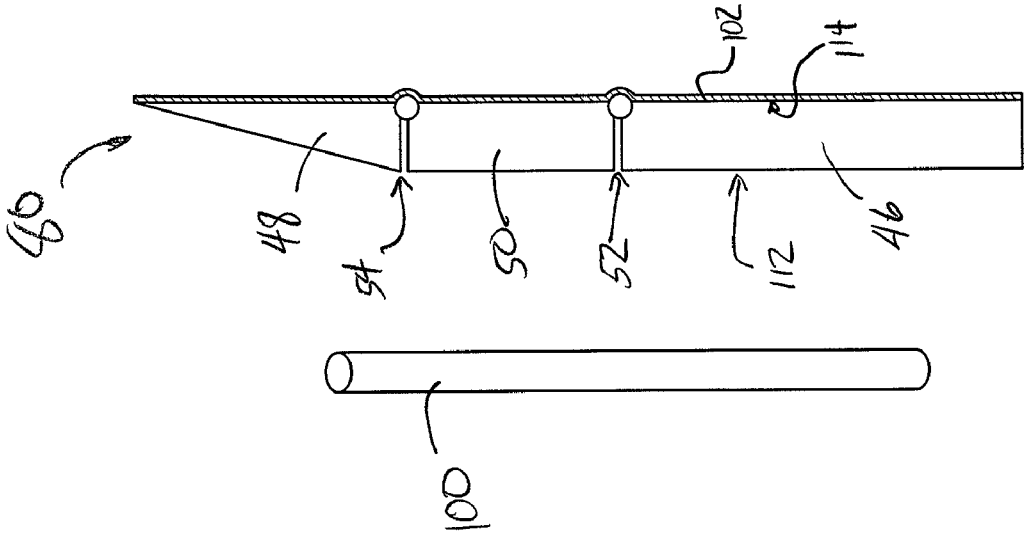
FIG. 6
FIG. 7

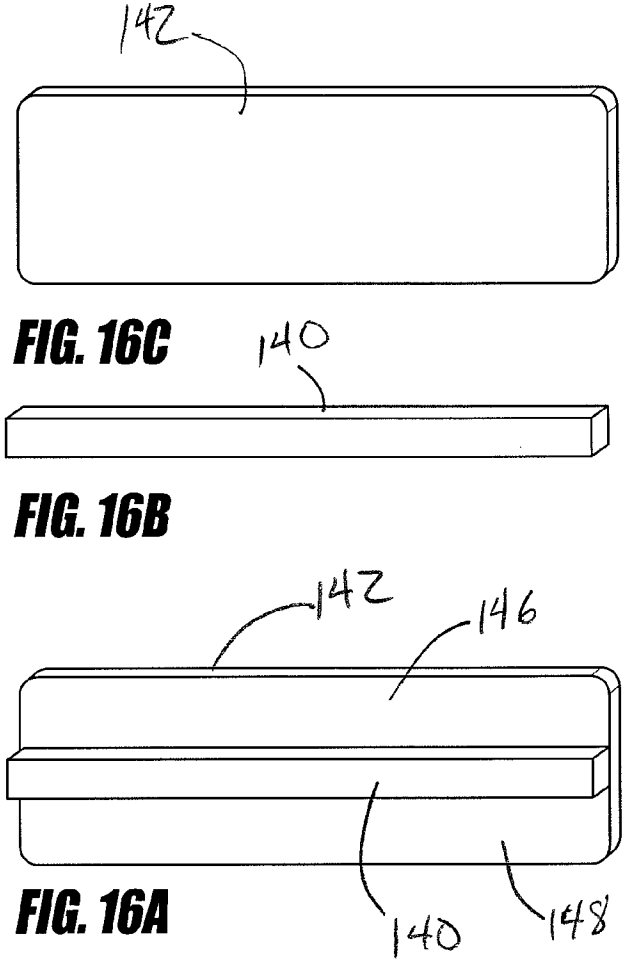
FIG. 16C
FIG. 16B
FIG. 16A
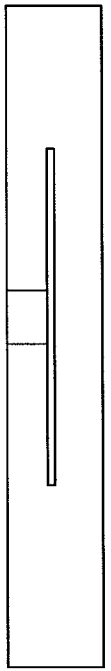
FIG. 15B
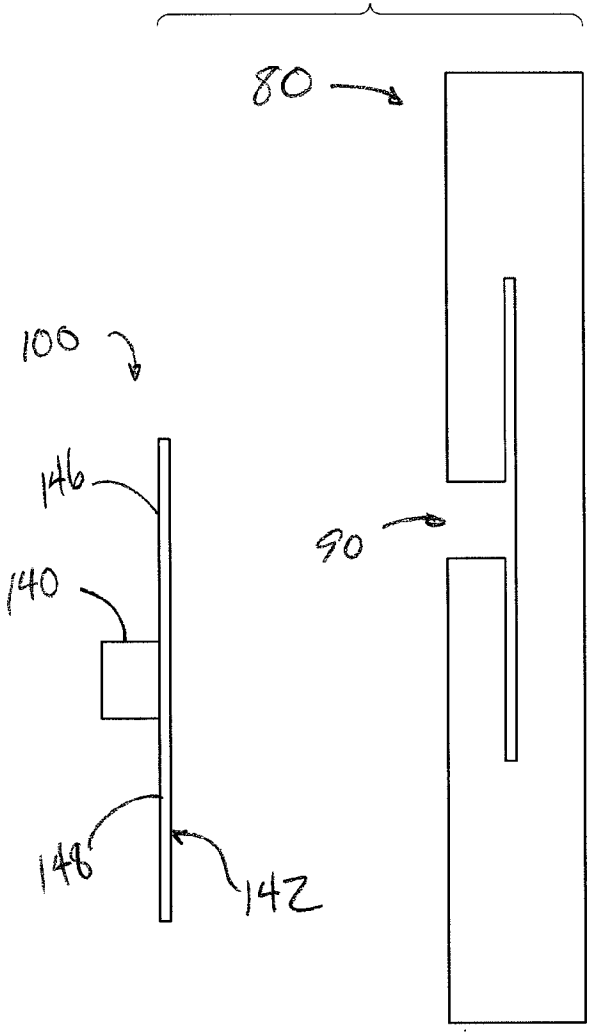
FIG. 15A

PROTECTIVE PADS HAVING CUSTOMIZABLE FLEXIBILITY

RELATED APPLICATION

This application claims priority to U.S. Provisional Application No. 60/903,465, entitled Protective Pads Having Customizable Flexibility, filed Feb. 26, 2007, the entirety of which is hereby incorporated by reference.

BACKGROUND OF THE INVENTION

1. Field of the Invention

The present invention relates to protective sports gear. More specifically, the present invention relates to protective gear having flex zones that are configured so that a user can customize the flexibility of such flex zones.

2. Description of the Related Art

Hockey is a fast-moving, competitive sport involving extensive contact between players and implements such as sticks and pucks. Hockey goalkeepers encounter a particularly high level of such contact as players attempt to advance the puck into a goal guarded by the goalkeeper. The goalkeeper attempts to prevent the puck from entering the goal by catching or blocking the puck with a hockey stick, the goalkeeper's body, and/or pads worn by the goalkeeper.

Hockey goalkeepers wear an extensive amount of protective gear both to protect their body from injury that may result from impacts with a fast moving puck and to use as tools for blocking the puck. For example, hockey goalkeepers wear bulky leg pads both to protect their legs and to block the puck. A goalkeeper will often drop to one or both knees with his feet spread apart so that one or both of the leg pads contacts the playing surface. The puck cannot pass between the pad and the playing surface and thus will be blocked from entering the goal.

In view of their role, goalkeeper leg pads generally have a boxy shape and are bulky. Traditionally, such goalkeeper leg pads are relatively inflexible. However, some goalkeepers prefer some flexibility in their pads to facilitate athletic movement by the goalkeeper. Due to their bulky construction, even relatively flexible goalkeeper leg pads typically flex substantially only at specific flex zones. Depending on the particular goalkeeper's size and style, however, targeted flexure at a particular flex zone may not be to that goalkeeper's liking. For example, some goalkeepers prefer a flex zone immediately below the knee while others prefer a flex zone immediately above the knee. Also, the desired degree of flexibility of the flex zones may vary between goalkeepers. To obtain leg pads having their desired flexibility characteristics, goalkeepers often must custom-order such pads.

SUMMARY OF THE INVENTION

Accordingly, there is a need in the art for a protective gear system, specifically a protective padding system, which allows the user to customize the flexibility characteristics of a particular pad member according to his liking.

In accordance with one embodiment, the present invention provides a selectively customizable padding apparatus. The apparatus comprises a pad member having a surface, a plurality of cavities formed in the pad member, and a plurality of inserts sized and adapted to selectively fit into a selected one of the cavities. The pad member is configured to preferentially flex at each of the cavities. The insert is configured to resist flexure of the corresponding cavity when the insert is engaged in the cavity so as to make the pad member more rigid at the cavity. A user may selectively control the location and flexibility of portions of the pad member by selectively engaging or disengaging one or more inserts into one or more of the cavities.

In some embodiments, the insert is configured to resist compression of the cavity when the insert is engaged with the cavity. In other embodiments, a system is provided including inserts of various compliance characteristics, and a user can vary flexure characteristics of the pad member by selectively engaging particular inserts in cavities at particular locations.

In accordance with another embodiment, a protective leg member for a hockey goalkeeper is provided. The leg member comprises a pad member having a front side and a back side. A cavity is formed in the pad member, and the cavity and pad member are adapted so that the pad member preferentially flexes at the cavity. An insert is adapted to be selectively engaged into the cavity. The insert is configured to reinforce the pad member when engaged in the cavity so as to make the pad member more rigid at the cavity. A hockey goalkeeper may selectively modify the flexure characteristics of the pad member by selectively engaging or disengaging the insert into the cavity.

In another embodiment, the pad member comprises a plurality of inserts adapted to be selectively engaged into the cavity, and the plurality of inserts each have different flexibility characteristics.

In yet another embodiment, the pad member comprises a plurality of cavities, and the location of preferentially flexible zones of the pad member are determined by selectively engaging an insert into a specific one or ones of the cavities.

In some embodiments the insert has a cross sectional shape that is substantially complementary to the cavity. In further embodiments the insert comprises a block portion that is sized to fit in the cavity and configured to resist compression of the cavity when the pad member is subjected to forces. In still other embodiments the insert comprises a web portion sized and configured to reinforce the pad member against bending.

In yet further embodiments, the cavity extends across substantially the entire width of the pad member. In some such embodiments the insert has a length substantially the same as a length of the cavity. In other such embodiments the insert has a length substantially less than a length of the cavity.

In still another embodiment, the pad member comprises a padding segment and a cavity liner. The padding segment comprises a first material, and the cavity liner comprises a second material. The second material is less compliant than the first material, and the cavity is formed in the cavity liner.

BRIEF DESCRIPTION OF THE DRAWINGS

FIG. 6 is a schematic side view of a pad member of a hockey goalkeeper leg protection member in accordance with one embodiment.

FIG. 7 is a perspective view of an insert configured to be used with the pad member of FIG. 6.

FIG. 8 is a schematic back view of the pad member of FIG. 6 with a cover removed and showing tubular inserts being inserted into first and second cavities.

FIG. 9 is a schematic back view of the pad member of FIG. 6 with the cover in place.

FIG. 15A is a schematic side view of still another embodiment of a pad member having a cavity formed therein, and an insert adapted to fit into the cavity.

FIG. 15B shows the embodiment of FIG. 15A with the insert fit into the cavity.

FIG. 16A is a perspective view of the insert of FIGS. 15A and B.

FIG. 16B is a perspective view of a block portion of the insert of FIG. 16A.

FIG. 16C is a perspective view of a web portion of the insert of FIG. 16A.

DETAILED DESCRIPTION OF PREFERRED EMBODIMENTS

Embodiments will be disclosed in connection with the above-described figures. These embodiments involve a hockey goalkeeper leg protection member, which benefits substantially from aspects of the present invention. However, it is to be understood that the discussion herein in context of such a hockey implement is made to illustrate inventive aspects, and the present invention is not limited to protective pads for hockey. Rather, principles discussed herein can be applied to any padding system in which flexure customization could be beneficial.

Figure 1:
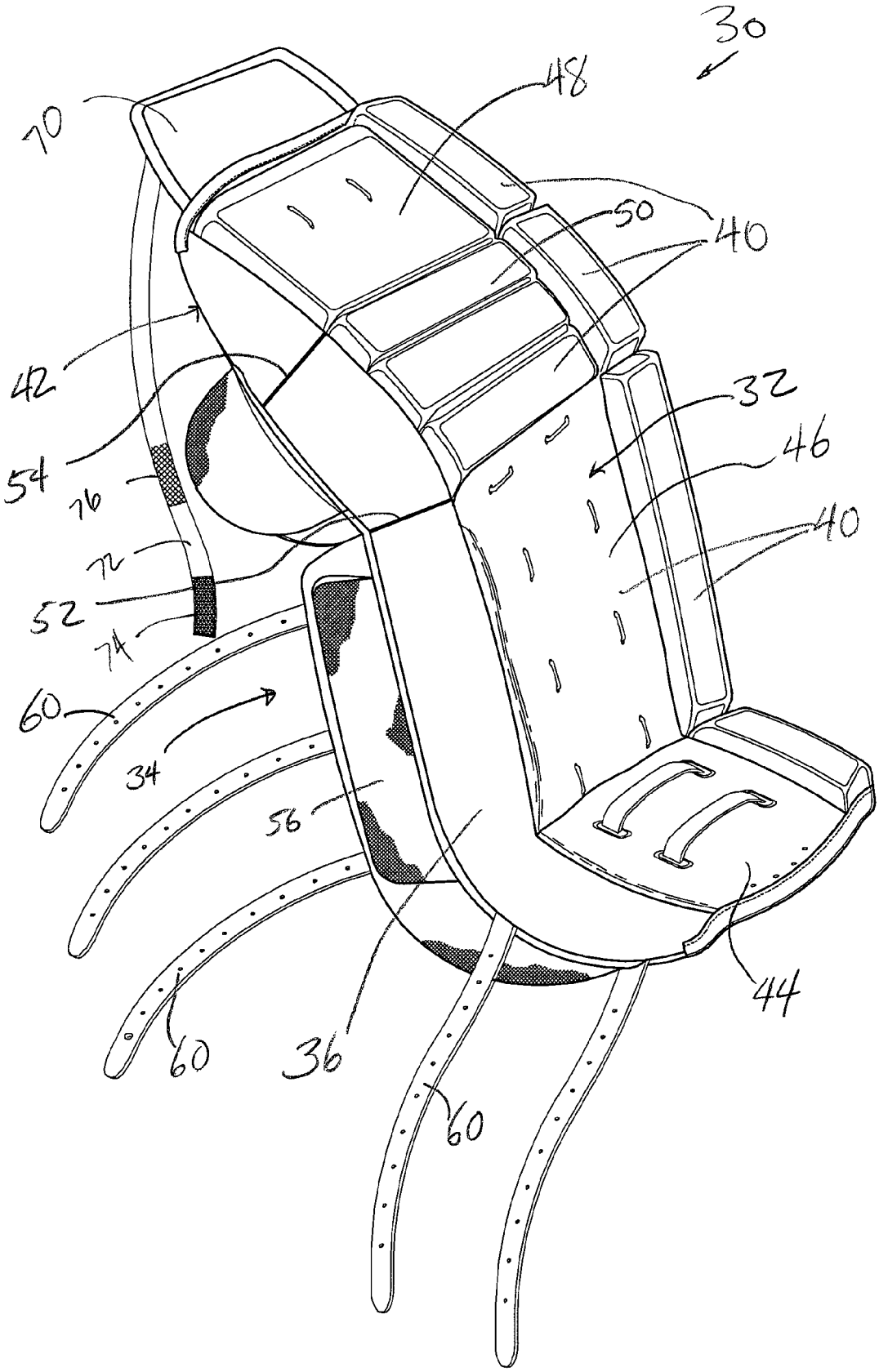
FIG. 1 is a perspective view of an embodiment of a leg protection member adapted to be attached to a hockey goalkeeper's left leg.
Figure 2:
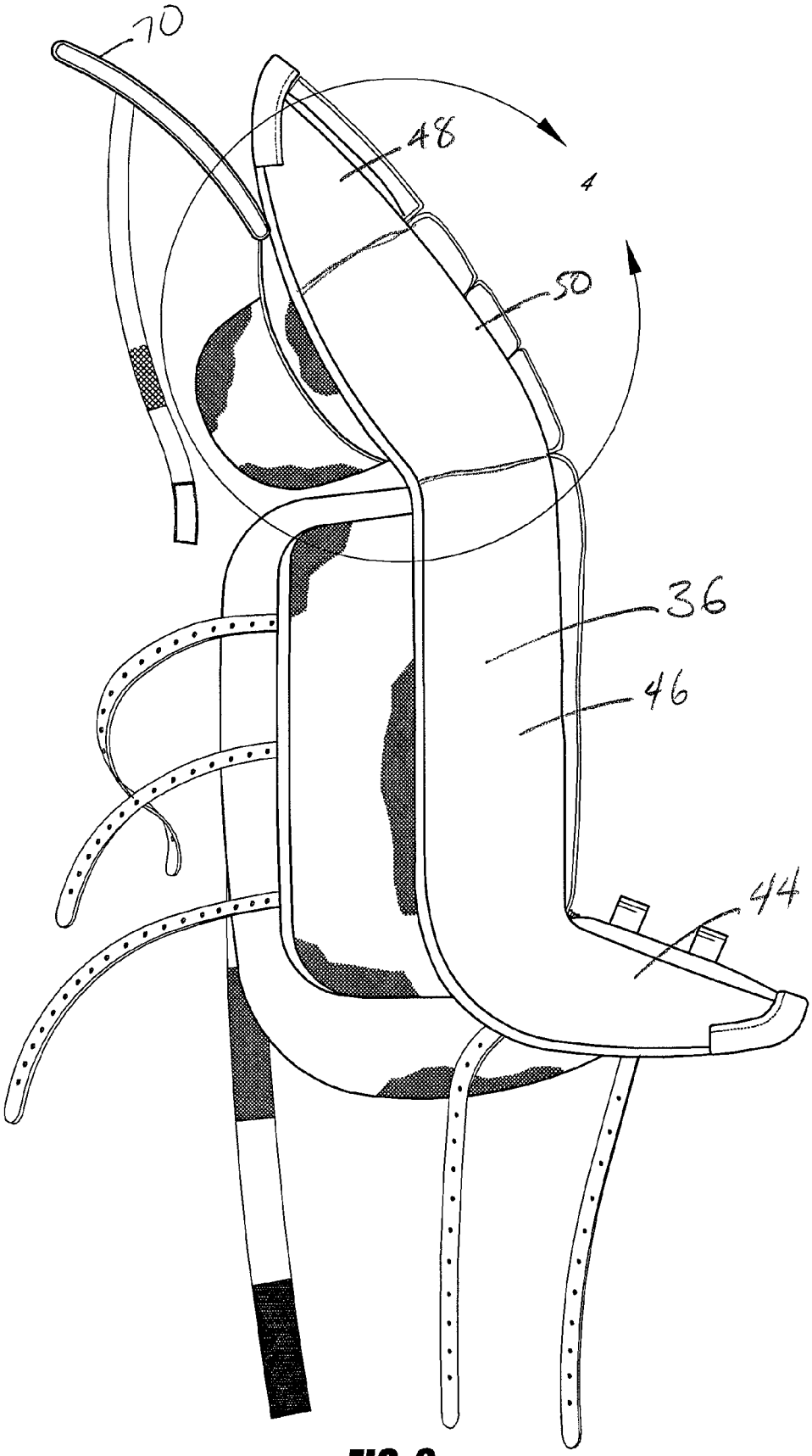
FIG. 2 is a side elevational view of a first, inner side of the leg protection member of FIG. 1.
Figure 3:
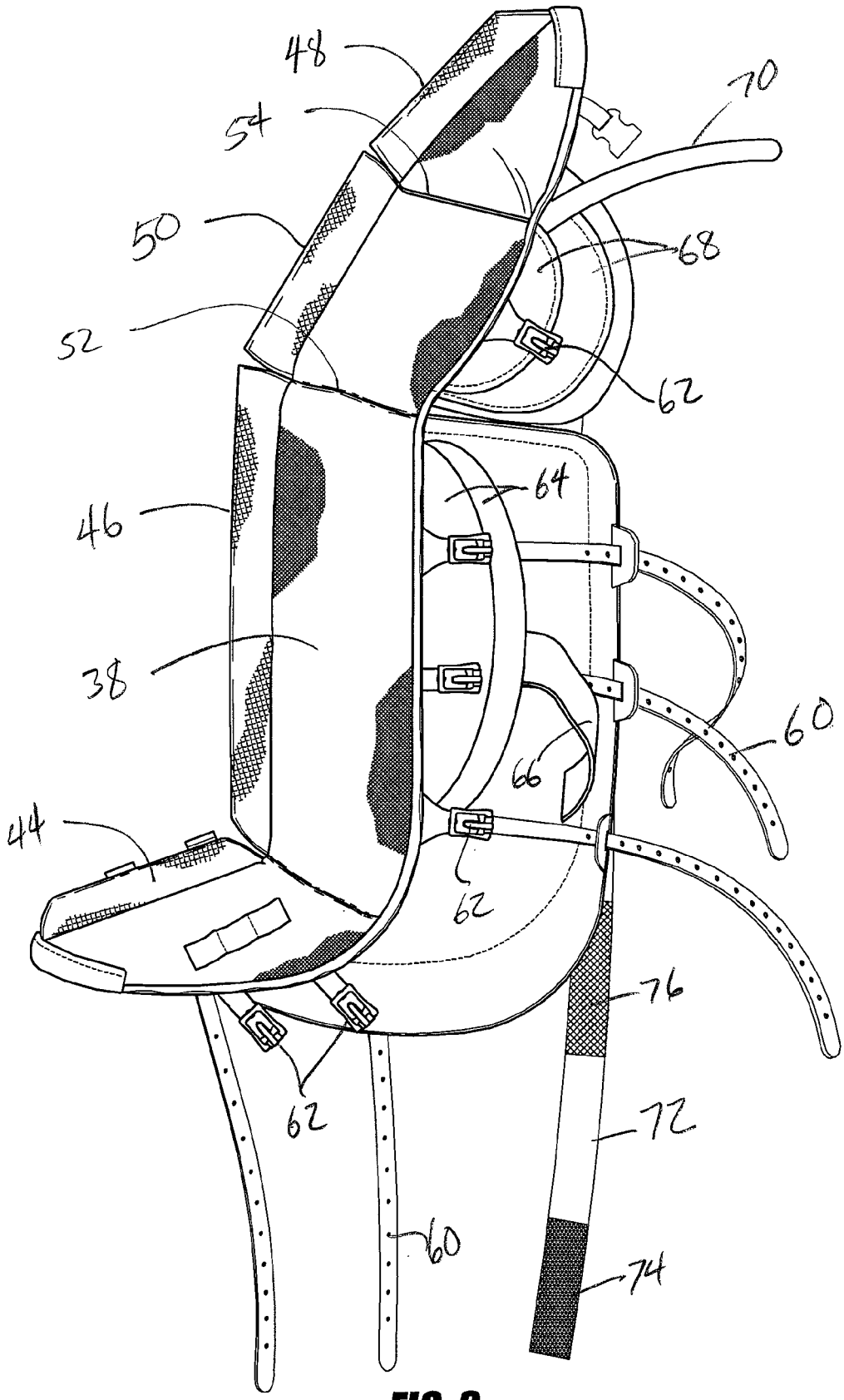
FIG. 3 is a side elevational view of a second, outer side of the leg protection member of FIG. 1.

With first reference to FIGS. 1-3, a leg protection member 30 is illustrated. The illustrated leg protection member 30 is specially configured to be attached to a hockey goalkeeper's left leg. Preferably, a symmetrical leg protection member is configured to be attached to the hockey goalkeeper's right leg. The illustrated leg protection member 30 comprises a front 32, a back 34, a first side 36, and a second side 38. The member 30 is configured so that, when worn, the back 34 is disposed against the front of the wearer's leg; the front 32 is disposed opposite the back 34 and faces away from the wearer, and the first and second sides 36, 38 extend between the front 32 and back 34. The first side 36 is configured to be disposed adjacent the hockey player's inner leg and the second side 38 is disposed adjacent the outer leg.

The leg protection member 30 comprises several padding segments 40. Each padding segment preferably comprises an impact absorbent material such as foam, an elastomer, or the like. The impact absorbent material can also comprise a substantially rigid material such as a rigid plastic plate alone or in combination with a foam.

Preferably, at least some of the padding segments 40 are hinged relative to one another so that adjacent segments can pivot or otherwise move relative to one another. Throughout this specification, the term "hinged portion" is a broad term that is used in accordance with its ordinary meaning and includes, for example, adjacent padding segments that are attached to one another, but remain movable relative to one another. In some embodiments, a unitarily-formed padding member may be configured so as to have a plurality of segments. This can be accomplished by, for example, varying the thickness of the padding member, cutting or scoring the padding member, and/or forming a cavity in the padding member so that it preferentially bends in a selected flex zones, or hinge portions, that can define the edges of segments.

With continued reference to FIGS. 1-3, preferably the padding segments 40 of the leg protection member 30 are encased in a cover 42. In the illustrated embodiment, the cover 42 comprises several portions of textile material joined together to cover padding material. In one embodiment, the padding material comprises waffle-type foam material processed in any suitable manner. The cover 42 preferably comprise a flexible textile such as a suitable synthetic material like DuPont Cordura™ nylon, manufactured by E.I. du Pont de Nemours and Company or other materials such as Clarino, natural or synthetic leather, polyvinylchloride (PVC) and polyurethane (PU). Preferably, the cover 42 extends over multiple adjacent padding segments 40.

With continued reference to FIGS. 1-3, the front 32 of the leg protection member 30 comprises a foot portion 44, a lower leg portion 46, an upper leg portion 48 and a knee portion 50. In the illustrated embodiment, the portions are arranged to generally conform to the anatomy of a relaxed human leg. Preferably, the padding portions are arranged so that a first hinge portion 52, or first flex zone, is disposed at the connection between the lower leg portion 46 and knee portion 50 so as to be generally just below a wearer's knee, and a second hinge portion 52, or second flex zone, is disposed at the connection between the knee portion 50 and the upper leg portion 48 so as to be generally just above the wearer's knee. As such, the first and second flex zones 52, 54 are defined just above and just below the wearer's knee in the illustrated embodiment.

In the illustrated embodiment, a generally rigid calf guard 56 extends rearwardly from the intersection of the first side 36 and the back 34 of the leg protection member 30. Preferably, the calf guard 56 comprises a generally rigid protective plate therein. Several straps 60 also extend from the intersection of the first side and the back. A plurality of buckles 62 extend rearwardly from the intersection of the second side 38 and the back 34. The buckles 62 are configured to releasably engage the straps 60 so as to enable a wearer to releasably attach the leg protection member 30 to his leg.

A pair of calf pads 64 extend rearwardly from the back 34 of the leg protection member 30. The calf pads 64 are configured to fit on opposite sides of the wearer's calf. Preferably a strap 66 extends between the pads 64 and is affixed with a hook-and-loop fastener such as Velcro™ so as to enable the user to secure the calf pads around his calf. In a similar manner, a pair of lateral knee pads 68 extend rearwardly from the back 34 and are configured to be disposed on opposite sides of the wearer's knee. Still further, an upper thigh pad 70 extends from the back 34 and is configured to lie against the wearer's upper thigh. The upper thigh pad 70 additionally includes a strap 72 having a hook portion 74 and a loop portion 76 that are configured to engage one another to help secure the pad 70 to the wearer.

Figure 4:
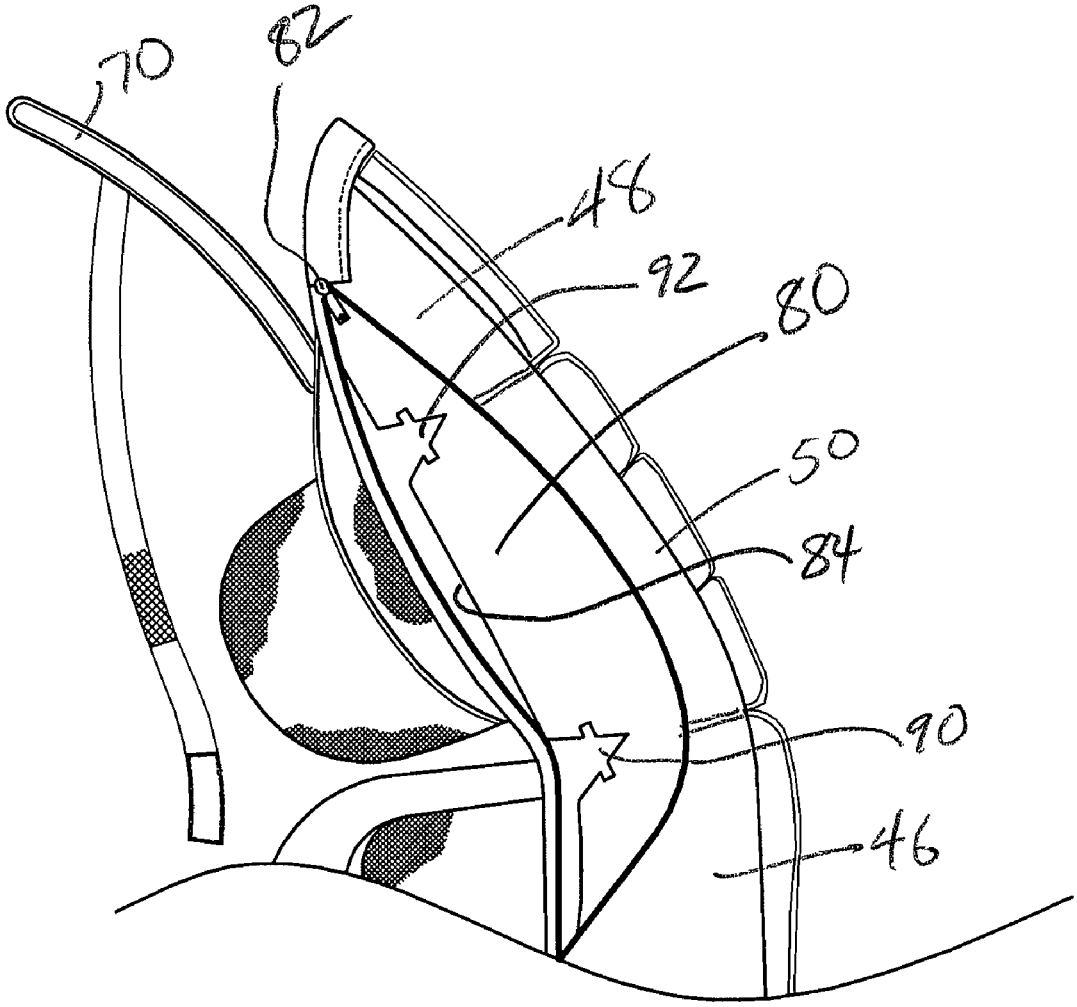
FIG. 4 is a close up view of a portion of the first side of FIG. 2, showing a zipper member open so as to expose a pad member of the leg protection member.

In the illustrated embodiment, a pad member 80 is enclosed within the cover 42, and provides substantial shape and padding of the leg protection member 30. With additional reference to FIG. 4, another embodiment is disclosed in which a zipper 82 is provided in the cover 42 generally along the intersection of the first side 36 and the back 34. As depicted in FIG. 4, when the zipper 82 is opened, a side of the internal pad member 80 is exposed. In the illustrated embodiment, the internal pad member 80 has a back side 82 in which first and second cavities 90, 92 are formed. The illustrated cavities 90, 92 are disposed to generally correspond to the first and second flex zones 52, 54 as discussed above. The presence of the cavities enhances the bendability of the pad member 80 at the first and second flex zones 52, 54.

Figure 5A:
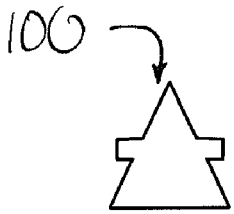
FIG. 5A is a perspective view of an insert adapted to fit complementarily into a corresponding cavity formed in the pad member of FIG. 4.
Figure 5B:
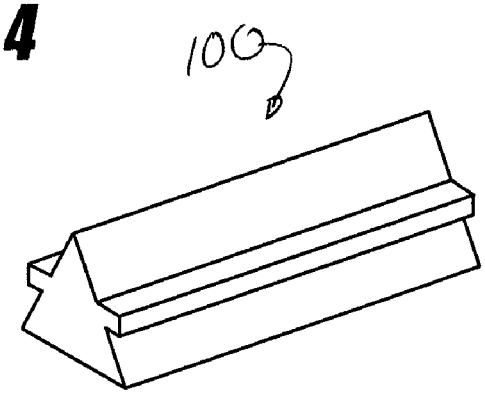
FIG. 5B is a cross-sectional view of the insert of FIG. 5A.

With additional reference to FIGS. 5A and 5B, an elongate insert 100 is provided that has a cross-sectional shape generally complementary to the first and second cavities 90, 92 formed in the pad member 80. Preferably the insert 100 has a length about the same as the width of the pad member 80. When the zipper 82 is open as depicted in FIG. 4, the cavities 90, 92 are accessible, and inserts 100 can be engaged in a corresponding cavity and slid into place, substantially filling the cavity.

In a preferred embodiment, the insert 100 is constructed of a material that is more rigid than the adjoining portions of the pad member 80. As such, the insert resists deformation (specifically crushing), and thus resists bending of the pad member at the corresponding flex zone. With a rigid insert in place, the pad member is stiffened, and no longer flexible at the corresponding flex zone.

It is to be understood that, in other embodiments, inserts can be constructed of a broad range of materials, both relatively rigid and relatively flexible. For example, inserts can be formed of hard plastics, metals, composites and high density foams. However, inserts can also be formed of medium or low density flexible foams, elastomeric materials, or the like. Inserts may also include mechanical structures, such as a flexible spring member or the like. As such, an insert having nearly any desirable flexibility characteristic may be provided, and inserts can be more or less flexible than the adjoining portions of the pad member. Nevertheless, placing an insert into a corresponding cavity will affect the flexibility characteristics of the pad member at the corresponding hinge portion. Notably, the effect of the insert can range from making the pad substantially stiff and unbending at the hinge portion to providing varying degrees of stiffness as desired.

With reference next to FIGS. 6-9, another embodiment of a pad member 80 for a goalkeeper leg protection member 30 is shown schematically to illustrate inventive aspects. The pad member 80 comprises a front 112, a back 114, a lower leg portion 46, an upper leg portion 48 and a knee portion 50 between the upper and lower leg portions. A first hinge portion/flex zone 52 is disposed between the lower leg portion 46 and the knee portion 50 and a second hinge portion/flex zone 54 is disposed between the knee portion 50 and the upper leg portion 48. Preferably a back cover 102 is disposed over the back 114 of the pad member 80.

As shown in FIG. 6, preferably first and second cavities 90, 92 are formed generally corresponding to the first and second hinge portions 52, 54. FIG. 7 depicts a generally-rigid tubular insert 100 that can be selectively slid into place in either of the first and second cavities 90, 92, as shown in FIG. 8. As discussed above, a tubular insert 100 can be placed in either one or both of the first and second cavities so as to change the flexibility characteristics of the pad member 80 at the respective hinge portions 52, 54. In the illustrated embodiment, first and second zippers 106, 108 are formed through the back cover 102 so as to provide access to the first and second cavities 90, 92 so that the inserts 100 can be selectively slid into place.

Although the illustrated embodiment shows a zipper, it is to be understood that any desired method and structure for providing access to the cavities may be employed. For example, in another embodiment an access opening can be selectively closed using buttons. In yet another embodiment a flap extends over an access opening. Hook-and-loop fastener components on the flap and the cover can be selectively engaged to selectively close the access opening. In still another embodiment, the access opening may remain open and accessible.

With next reference to FIGS. 10A-D, another embodiment is illustrated schematically so as to demonstrate flex characteristics of a pad member 80 depending on the presence or absence of an insert 100 in a corresponding cavity 90, 92. In the illustrated embodiment, the pad member 80 comprises a lower leg portion 46, and upper leg portion 48, and a knee portion 50. The lower leg portion 46 and the knee portion 80 are adapted to bend relative to one another at a first hinge portion 52. The upper leg portion 48 and the knee portion 50 are adapted to bend relative to one another at a second hinge portion 54. A first cavity 90 is formed into a back surface 114 at the first hinge portion 52, and a second cavity 92 is formed into a back surface 114 at the second hinge portion 54.

Figures 10A, 10B, 10C, 10D:
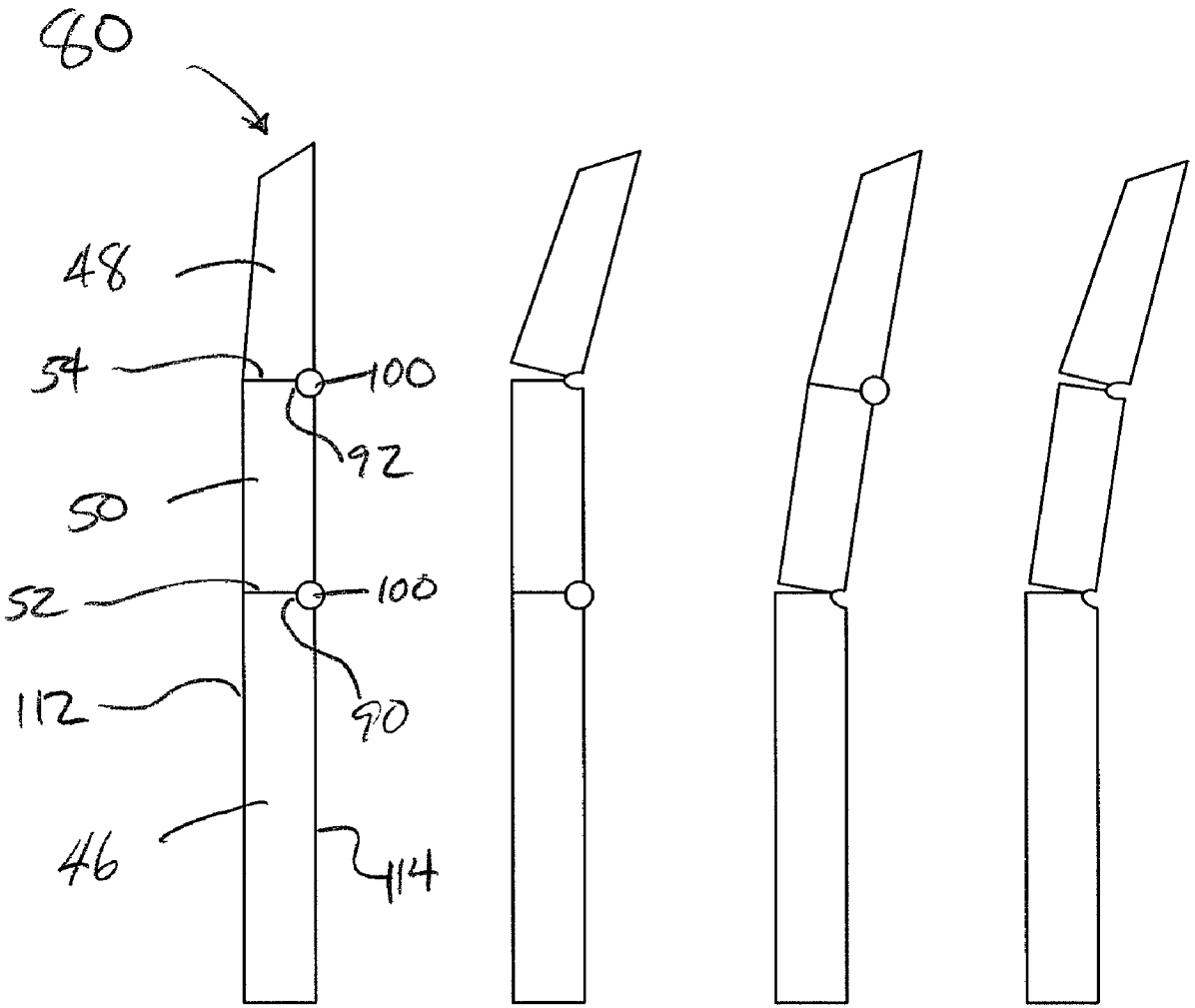
FIG. 10A is a schematic side view of an embodiment of a pad member of a hockey goalkeeper leg protection member, shown in a first configuration with stiffening inserts disposed in first and second cavities.
FIG. 10B shows the pad member of FIG. 10A in a configuration in which a first insert is disposed in the first cavity but the second cavity has no insert and thus a second hinge portion is flexible, thus defining a second flex zone.
FIG. 10C shows the pad member of FIG. 10A in a configuration in which a second insert is disposed in the second cavity but the first cavity has no insert and thus a first hinge portion is flexible, thus defining a first flex zone.
FIG. 10D shows the pad member of FIG. 10A in a configuration in which the first and second cavities both do not have inserts, and thus the first and second hinge portions are flexible and define first and second flex zones.

As shown in FIG. 10A, when a rigid insert 100 is disposed in both the first and second cavities 90, 92, the pad member 80 is generally rigid, and doesn't readily bend at the first and second hinge portions 52, 54. When a rigid insert 80 is disposed in the first cavity 90 but not the second cavity 92, as shown in FIG. 10B, the pad member 80 is generally rigid at the first hinge portion 52, but flexes at the second hinge portion 54. Similarly, when a rigid insert 100 is disposed in the second cavity 92 but not the first cavity 90, as shown in FIG. 10C, the pad member flexes at the first hinge portion 52 but is generally rigid at the second hinge portion 54. Further, when both the first and second cavities 90, 92 are free of inserts 100, the pad member 80 flexes readily at both the first and second hinge portions 52, 54.

It is to be understood that inserts of various sizes and shapes may be employed, and that corresponding cavities of various sizes and shapes may be employed. Preferably, the insert and cavity are shaped so as to be generally complementary to one another. However, in some embodiments, the insert is slightly larger than the cavity so as to impart a preload, thus further stiffening the pad member.

Figure 11:
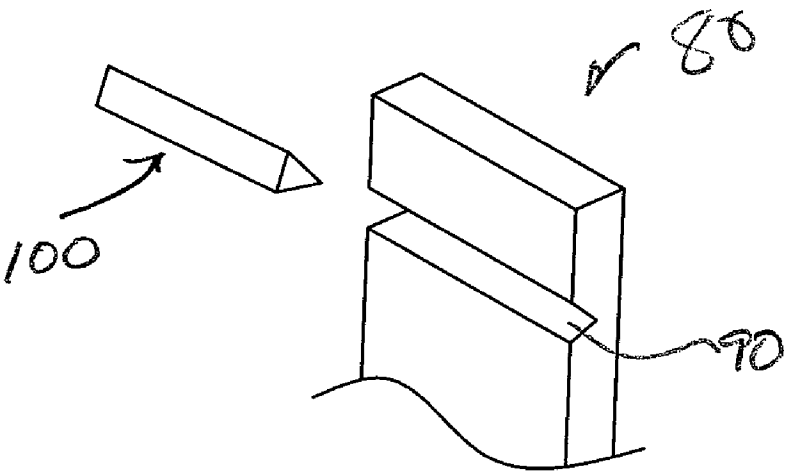
FIG. 11 is a schematic partial perspective view of an embodiment of a pad member having a cavity with a generally triangular cross-section formed therein and also showing an insert adapted to selectively fit into the cavity.
Figures 12A, 12B, 12C, 12D, 12E:
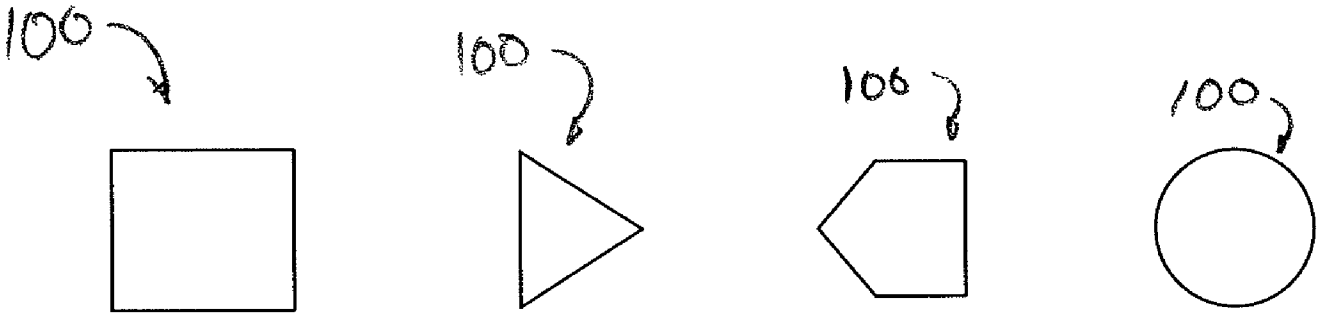
FIGS. 12A to 12E are cross-sectional views of embodiments of inserts that may fit into complementarily-shaped cavities formed in additional embodiments of padding members.

With next reference to FIG. 11, another embodiment of a pad member 80 is illustrated having a generally wedge-shaped cavity 90 formed therein. A complementarily-shaped insert 100 having a generally triangular cross-sectional shape is adapted to fit complementarily into the cavity.

In another embodiment, the triangular insert is shaped so that it does not completely fill the wedge-shaped cavity when inserted therein. As such, with the insert in place, the pad member flexes with little resistance until the insert is engaged, at which time the pad member becomes resistant to further bending. As such, such an embodiment may be employed to achieve a modified and limited flex characteristic.

FIGS. 12A-E depict cross-sectional views of multiple embodiments of inserts 100. Each of such inserts is preferably adapted for use with a cavity having a generally complementary shape. Each of the illustrated shapes can be expected to provide a characteristic flexibility profile when used in a pad member. It is to be understood that Applicant contemplates that inserts and cavities of several shapes and sizes can be employed as desired.

Figure 13A:
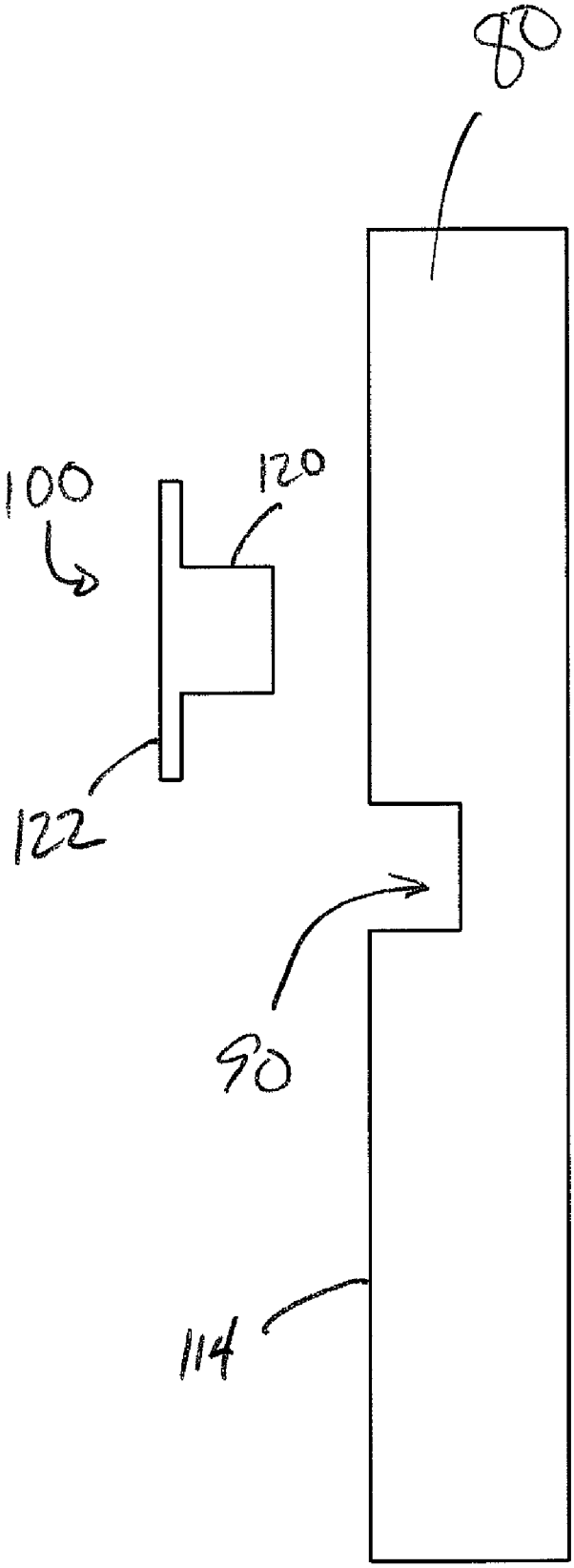
FIG. 13A is a schematic side view of another embodiment of a pad member having a cavity formed therein, and an insert adapted to fit into the cavity.
Figure 13B:
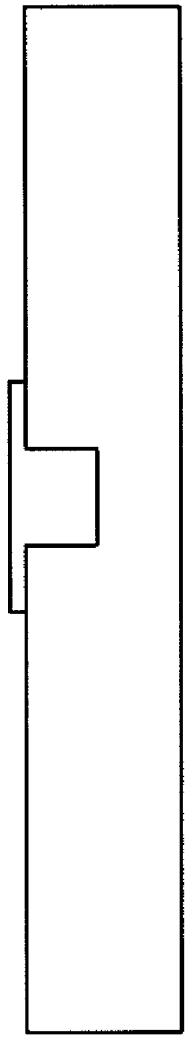
FIG. 13B shows the embodiment of FIG. 13A with the insert fit into the cavity.

With reference next to FIGS. 13A-B, another embodiment of a pad member 80 is provided. In the illustrated embodiment the pad member has a generally rectangular cavity 90 formed therein. The corresponding insert 100 has a generally T-shaped cross-sectional shape that defines a block portion 120 that is adapted to fit complementarily within the cavity 90 and a web portion 122 that abuts a back surface 114 of the pad member 80 adjacent the cavity 90. The block portion 120 fills the cavity 90 and thus provides stiffening to the pad member 80. The web portion 122 provides yet further stiffening support to help the pad member 80 resist bending at the cavity 90.

Figure 14A:
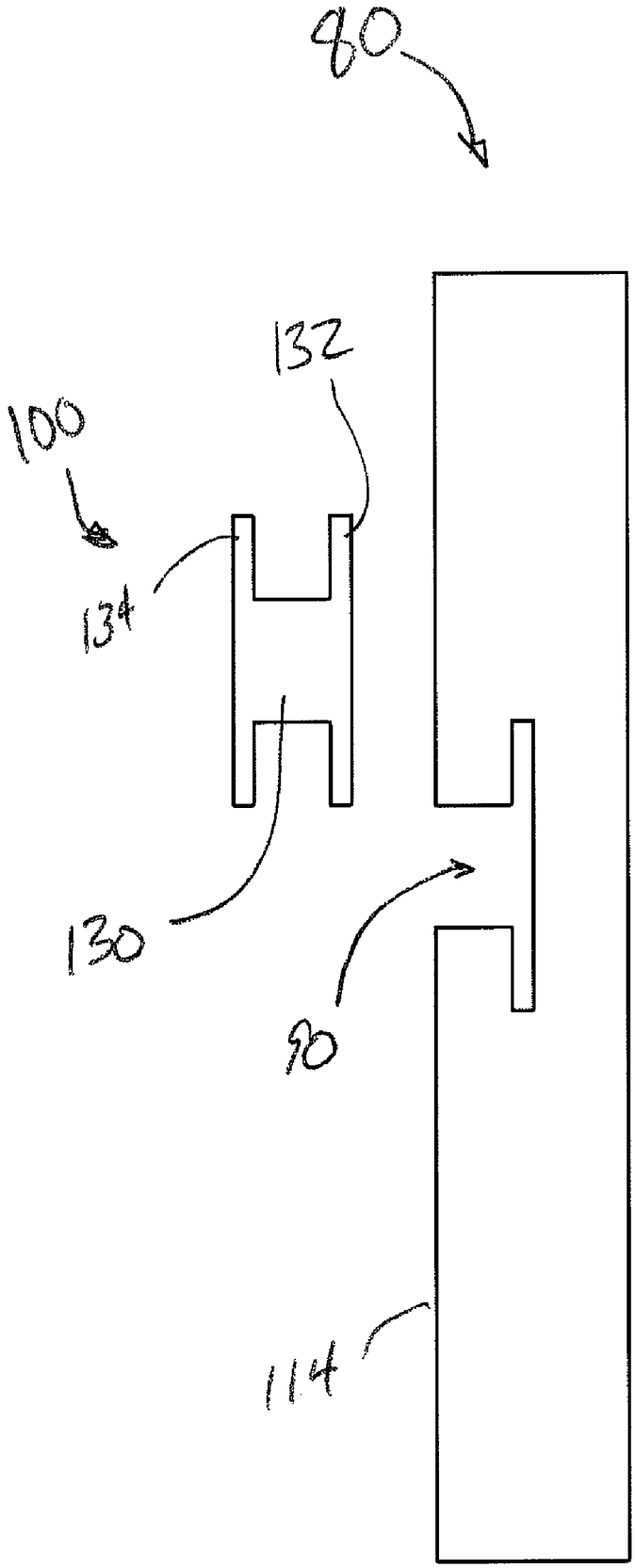
FIG. 14A is a schematic side view of yet another embodiment of a pad member having a cavity formed therein, and an insert adapted to fit into the cavity.
Figure 14B:
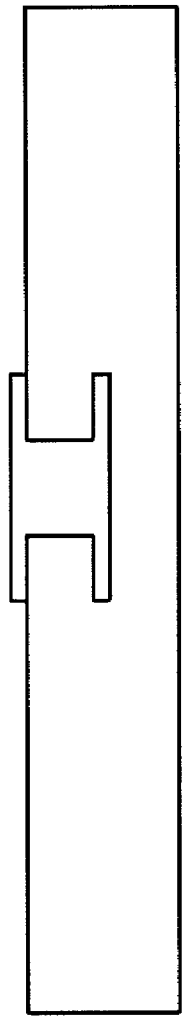
FIG. 14B shows the embodiment of FIG. 14A with the insert fit into the cavity.

With reference next to FIGS. 14A-B, yet another embodiment of a pad member 80 has a generally T-shaped cavity 90 formed therein. The corresponding insert 100 has a generally H-shaped cross-sectional shape that defines a block portion 130 disposed between first and second web portions 132, 134. The block portion 130 and first web portion 132 are sized and configured to fit complementarily in the cavity 90, and the second web portion 134 abuts a back surface 114 of the pad member 80 adjacent the cavity. The combination of the block portion 130 and the first and second web portions 132, 134 provides substantial stiffening to the pad member 80 at the cavity 90.

With reference next to FIGS. 15-16, still another embodiment of a pad member 80 has a generally T-shaped cavity 90 formed therein. The corresponding insert 100 has a generally T-shaped cross-section that is complementary to the cavity 90 and defines a block portion 140 and a web portion 142. When fit into the cavity 90, the web portion 142 provides substantial stiffening to the pad member 80 at and adjacent the cavity 90.

With particular reference to FIGS. 16A-C, in the illustrated embodiment the block portion 140 and the web portion 142 of the insert 100 are formed separately from one another. Preferably, the portions 140, 142 are attached to one another, such as by an adhesive. Of course, other methods and structure for connecting the portions can be employed. In a preferred embodiment, the block 140 is formed of a foam, and the web 142 is formed of a substantially rigid material such as a fiber-reinforced epoxy composite material. In other embodiments, the web may be formed of an extruded, molded or otherwise constructed plastic, metal, wood or the like.

In still further embodiments, a first part 146 of the web portion 142 on a first side of the block 140 may have different stiffness characteristics than a second part 148 of the web portion 142 on a second side of the block 140. For example, in an embodiment in which the web portion is formed by a fiber-reinforced composite layup, the first part 146 may include fewer fibrous layers than the second part, and/or the fibrous layers may be oriented so that the first part 146 is substantially more flexible than the second part 148. As such, flexibility characteristics of the associated padding member 80 can be even further customized, as the padding member 80 will be relatively stiff at portions adjacent the second part 148 of the web portion 144, but will be less stiff at portions adjacent the first part 146 of the web portion. Effectively the hinge portion flex zone 52 normally corresponding to the location of the cavity 90 will thus be shifted toward the portion of the pad member 80 that engages the first part 146 of the web portion 144.

Figure 17:
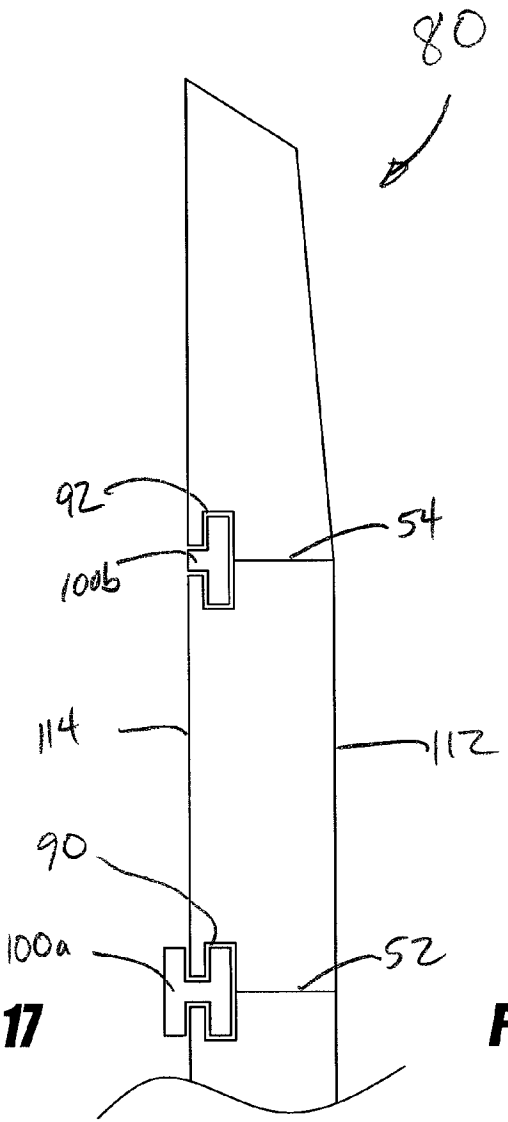
FIG. 17 is a schematic side view of yet another embodiment of a pad member having first and second cavities and showing first and second inserts fitting complementarily within such cavities, and the first and second inserts have different cross-sectional shapes.

With reference next to FIG. 17, another embodiment of a pad member 80 is illustrated. In this embodiment, first and second T-shaped cavities 90, 92 are formed generally corresponding to first and second hinge portions 52, 54. However, a generally H-shaped insert 100 is fit into the first cavity 90, and a generally T-shaped insert 100*b* is fit into the second cavity 92. In this embodiment, the H- and T-shaped inserts impart differing flex characteristics to their respective hinge portions due at least to their differing geometries. As such, these inserts 100 stiffen their corresponding flex zones, but to a differing degree. For example, in this embodiment although the pad member 80 will remain relatively stiff, the upper or second flex portion 54 will bend more readily than the first flex zone 52.

Figure 18:
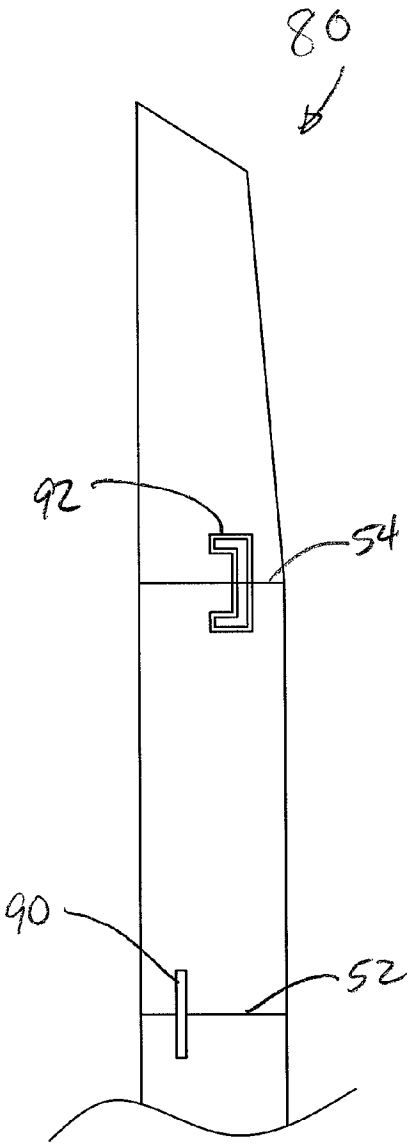
FIG. 18 is a schematic side view of still another embodiment of a pad member in which cavities are formed through the pad member between the front and back surfaces of the pad member.

With reference next to FIG. 18, still another embodiment is illustrated. In this embodiment, first and second cavities are formed generally corresponding to first and second hinge portions 52, 54, but at locations in the pad member 80 between the front and back surfaces 112, 114. Further, as shown, the first and second cavities may have different cross-sectional shapes. It is to be understood that cavities can be disposed in various locations in the pad member.

Figure 19:
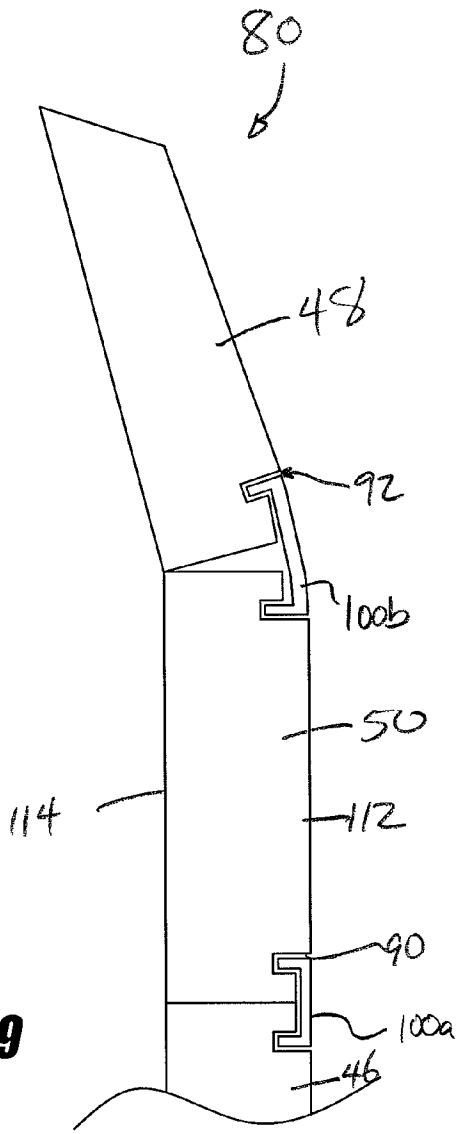
FIG. 19 is a schematic side view of a further embodiment of a pad member in which cavities are formed in a front side of the pad member, and a first insert is generally rigid, but a second insert is flexible and facilitates bending of the pad member at a second flex zone.

With reference next to FIG. 19, a still further embodiment of a pad member comprises first and second hinge portions 52, 54 that are configured so that as the pad member bends at the hinge portion, adjacent pad segments separate from one another, particularly at the front surface 112. In the illustrated embodiment, first and second cavities 90, 92 are disposed in the front surface 112 generally corresponding to respective hinge portions 52, 54. The illustrated cavities preferably have a reverse-C-shape. Corresponding first and second inserts 100*a*, 100*b* are configured so that the inserts fit substantially flush with the front surface 114 of the corresponding pad member 80.

In the illustrated embodiment, the first C-shaped insert 100*a* is relatively rigid and is shaped to fit complementarily into the first cavity 90 as shown. Specifically, the insert 100*a* maintains tension so as to prevent adjacent padding segments from separating from one another at the front surface 112. As such, the insert 100*a* substantially prevents operation of the first hinge portion 52. Also, the insert 100*a* sits flush with the front surface 112 of the pad member 80, thus maintaining a generally flat front surface of the leg protection member 30.

The second C-shaped insert 100*b* is shaped to fit complementarily into the second cavity 92. However, in the illustrated embodiment, the second insert 100*a* is at least partially formed of an elastomeric material such as rubber. As such, when the second hinge portion 54 bends, and the adjoining upper leg and knee portions 48, 50 move away from one another at the front surface 112 of the pad member 80, the second insert 100*b* stretches to accommodate such motion. The stretching second insert 100*b* facilitates generally unrestricted or only mildly-restricted flexure at the second hinge portion 54. As such, even when no or little stiffness is desired at the second hinge portion, an insert can be placed in the cavity so as to present a flat surface at the front 112 of the pad member 80.

Figure 20:
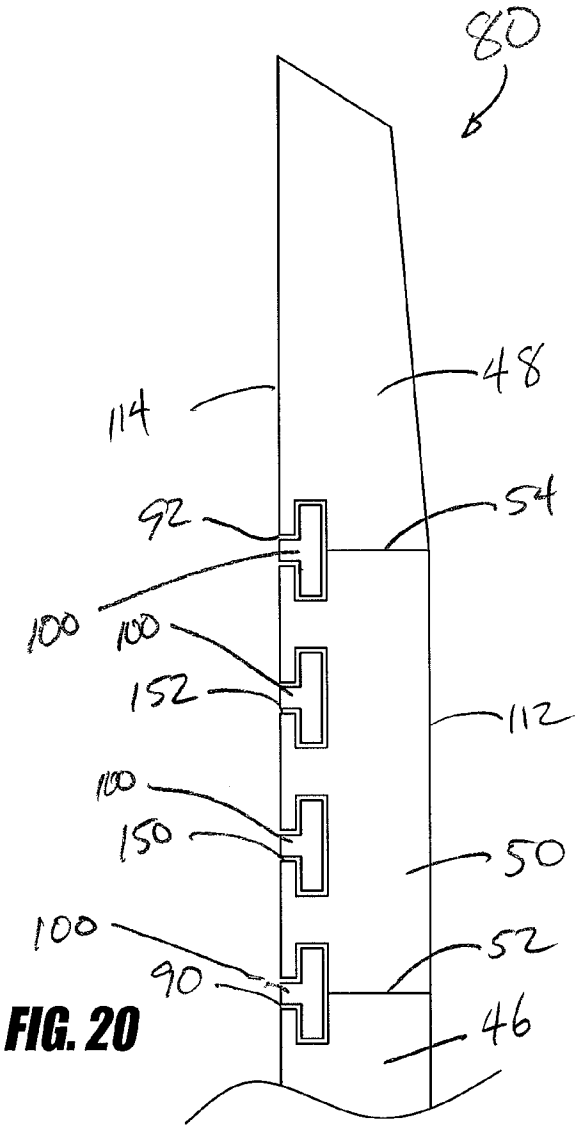
FIG. 20 is a schematic side view of still another embodiment of a pad member having more than two cavities.

With reference next to FIG. 20, another embodiment of a pad member 80 has first and second hinge portions 52, 54. First and second cavities 90, 92 are formed so as to generally align with the first and second hinge portions 52, 54, respectively, so as to affect flexibility and bending of the pad member 80 at the hinge portions 52, 54. In the illustrated embodiment, third and fourth cavities 150, 152 are provided between the first and second cavities 90, 92. In this embodiment, the wearer can selectively place inserts 100 in any combination of the first through fourth cavities so as to customize the flexibility of the pad overall, as well as the flexibility of the pad member at specific locations.

It is to be understood that, in other embodiments, any desired number of cavities can be provided. Such cavities may all have the same cross-sectional configuration, as in FIG. 20, or there may be a variety of cavity configurations and/or insert configurations to fit in such cavities, such as is demonstrated in connection with FIGS. 17-19.

Figure 21:
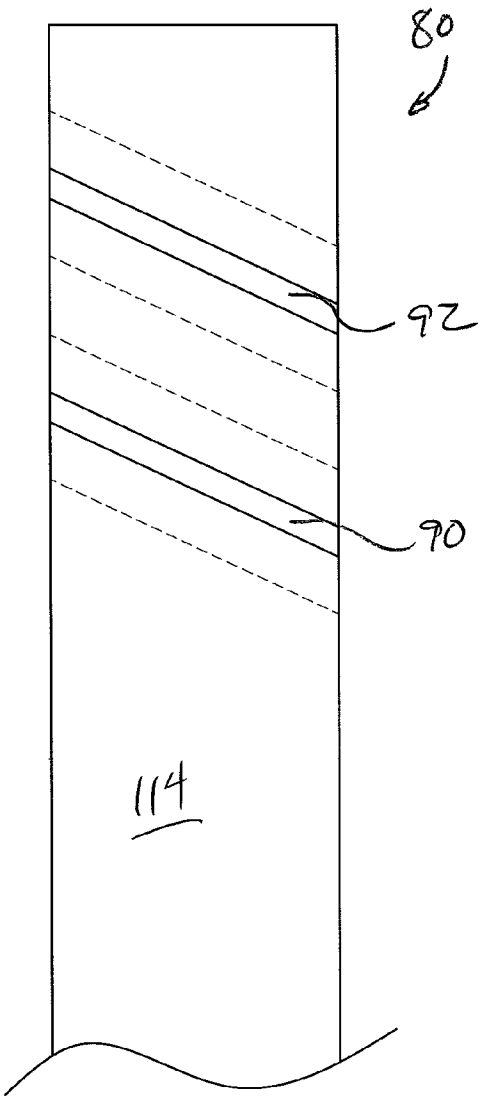
FIG. 21 is a schematic back view of a pad member having cavities formed generally diagonally across the pad member.

With reference next to FIG. 21, a back side view of yet another embodiment of a pad member 80 shows first and second generally T-shaped cavities 90, 92 extending across the back side 114 of the pad member 80, but at a diagonal relative to the pad member. In this embodiment, the hinge portions 52, 54 are arranged so that the lower leg 46, upper leg 48, and knee 50 pad portions are predisposed to bend at an angle relative to one another and along the corresponding diagonal cavity 90, 92. Some goalkeepers may find such a non-traditional bending pattern to be helpful in approximating their preferred knee bending characteristics. Of course, it is to be understood that still other non-traditional cavity configurations can be provided to customize directional bending as desired by the wearer.

Figures 22A, 22B, 22C:
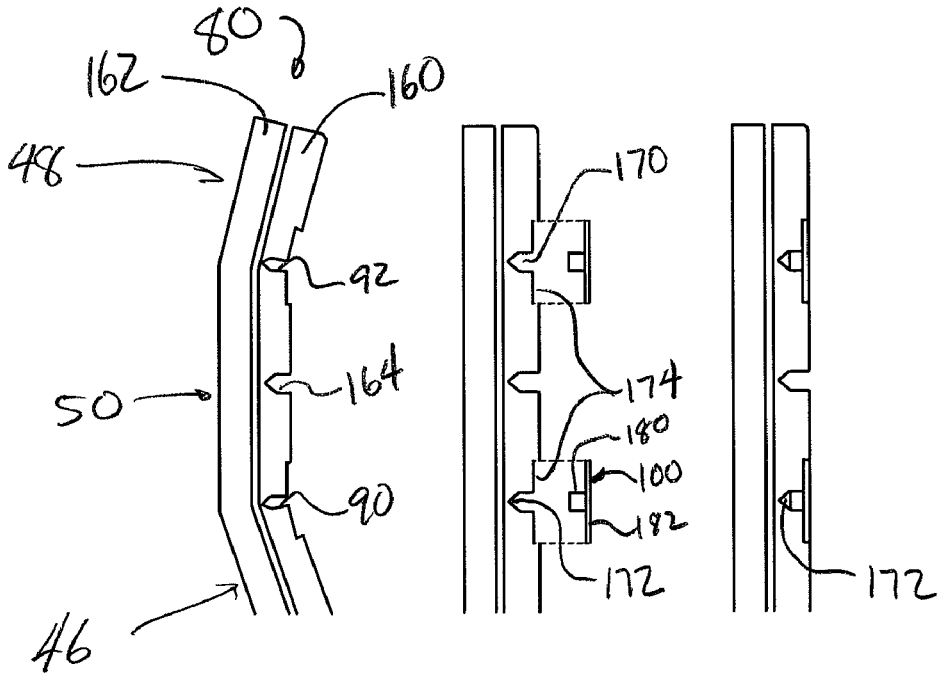
FIG. 22A is a schematic side view of yet another embodiment of a pad member having cavities formed therein.
FIG. 22B shows the pad member of FIG. 22A in conjunction with inserts adapted to fit into the cavities.
FIG. 22C shows the pad member of FIG. 22B with the inserts fit into cavities in the pad.
Figure 23:
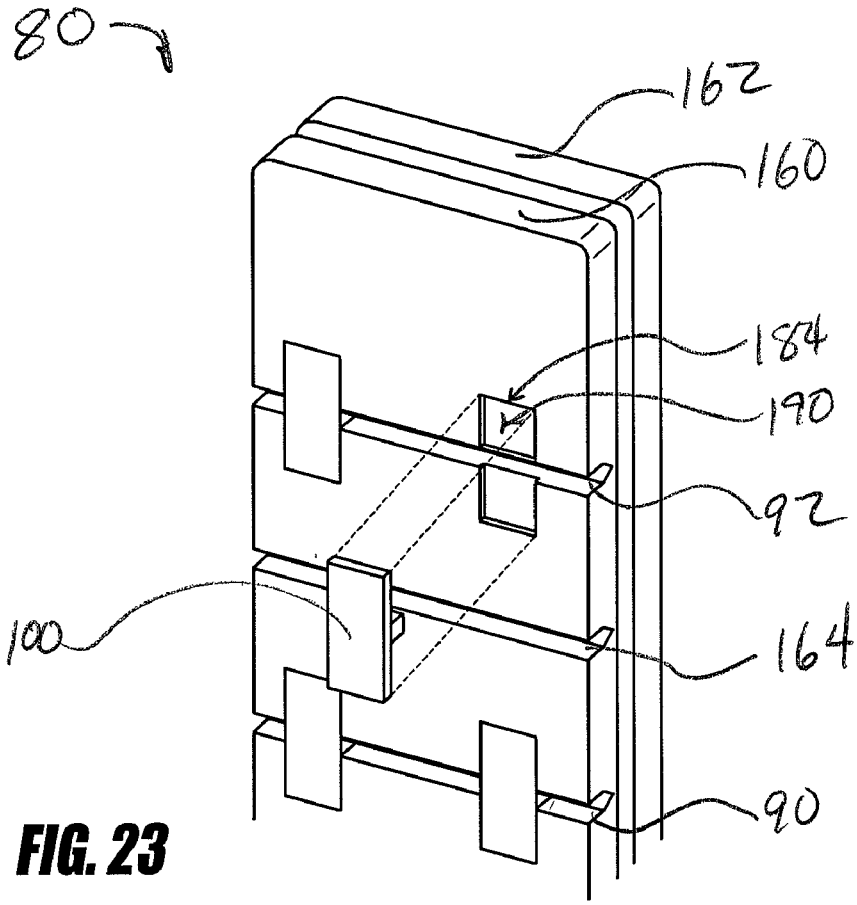
FIG. 23 is a perspective back view of an embodiment of a pad member having features in accordance with FIGS. 22A-C and showing placement of inserts into corresponding insert seats

With reference next to FIGS. 22-23, still another embodiment of a hockey pad member 80 is shown schematically. The pad member comprises a lower leg portion 46, an upper leg portion 48, and a knee portion 50. In this embodiment, the pad member comprises a first pad layer 160 and a second pad layer 162. First and second cavities 90, 92 are formed in the first layer 160. The first cavity 90 is disposed generally at the intersection of the lower leg portion 46 and the knee portion 50; the second cavity 92 is disposed generally at the intersection of the upper leg portion 48 and the knee portion 50. As such, the first and second cavities are arranged so as to be generally just below and just above, respectively, the wearer's knee.

Although the first and second cavities are formed only in the first layer 160, the cavities still impart a predisposition to bending (i.e., a flex zone or hinge) in the pad member 80 at the respective cavity, as demonstrated by FIG. 22A. In the illustrated embodiment, a third cavity 164 is formed in the knee portion generally between the first and second cavities. The third cavity provides yet a further flex zone imparting flexibility to the pad member. In this embodiment, the third cavity flex zone is generally centered in the knee portion, and facilitates some level of bending of the pad 80 at the knee portion. However, this configuration of the pad member enables selective control of the flexibility characteristics at the first and second cavities, just below and above the wearer's knee.

With continued reference to FIGS. 22A-C, the illustrated cavities 90, 92 each have a first portion 170 with a generally pentagonal cross-sectional shape. As such, and as shown, a point 172 of the pentagonal shape helps determine the point, or line of preferential bending of the pad member 80. A second portion 174 of the cavity is a generally shallow space in the back surface 114 of the pad member.

As shown in FIGS. 22B-C, an insert 100 preferably has a generally T-shaped cross-section, defining a block portion 180 and a web portion 182. The illustrated block portion is generally rectangular. The insert 100 fits complementarily within the cavity, with the web portion 182 fitting into the second cavity portion 174 so that the web portion sits generally flush with the back surface 114 of the pad member 80. In this embodiment, the block portion 180 fits into but does not completely fill the first cavity portion 170. Specifically the point portion 172 of the pentagonally-shaped cavity is left unfilled. However, since the block portion resists cavity crushing, which occurs during bending of the pad member at the cavity as shown in FIG. 22A, bending of the pad member 80 with the insert 100 in place is still resisted. The web member 182 provides substantial additional resistance to bending as well.

With specific reference to FIG. 23, in the illustrated embodiment, the inserts 100 do not extend fully across the back 114 of the pad member 80. Instead, two shallow second cavity portions 184 are formed in connection with each of the first and second cavities 90, 92. Each of the two shallow second cavity portions 184 is sized to complementarily accommodate the web portion 182 of a corresponding insert 100. As such, the shallow second cavity portions in combination with the cavity define a plurality of seats 190 for inserts 100. In this configuration there is no need to provide side access to the pad member in order to slide inserts into place.

Instead, the inserts can be placed directly into the back, or in some embodiments the front, of the pad member 80. Preferably the seats 190 are configured so that when an insert is in place the web portion of the insert fits flush against the back surface of the pad.

Figure 24A:
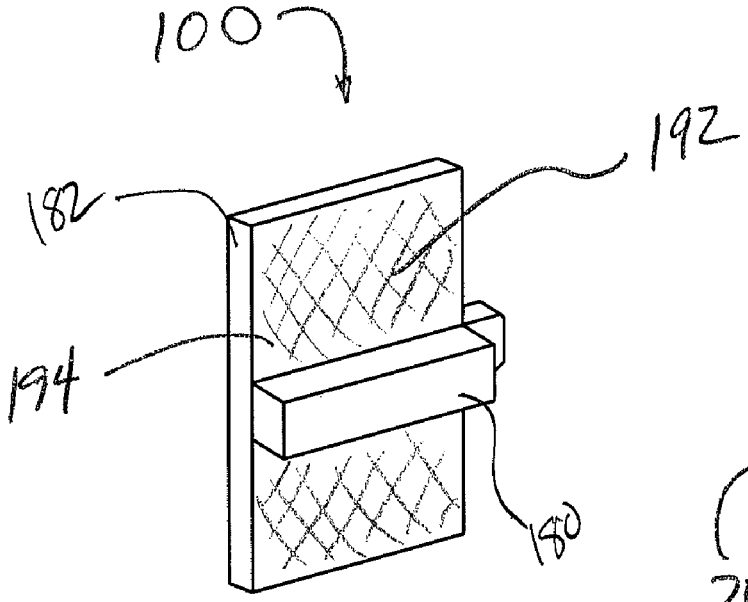
FIG. 24A is a perspective front view of an insert in accordance with another embodiment.
Figure 24B:
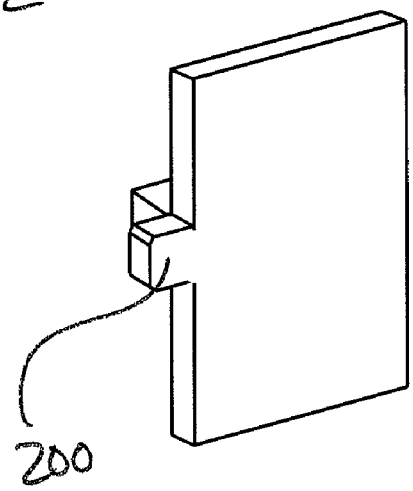
FIG. 24B is a perspective back view of the insert of FIG. 24A.
Figure 24C:
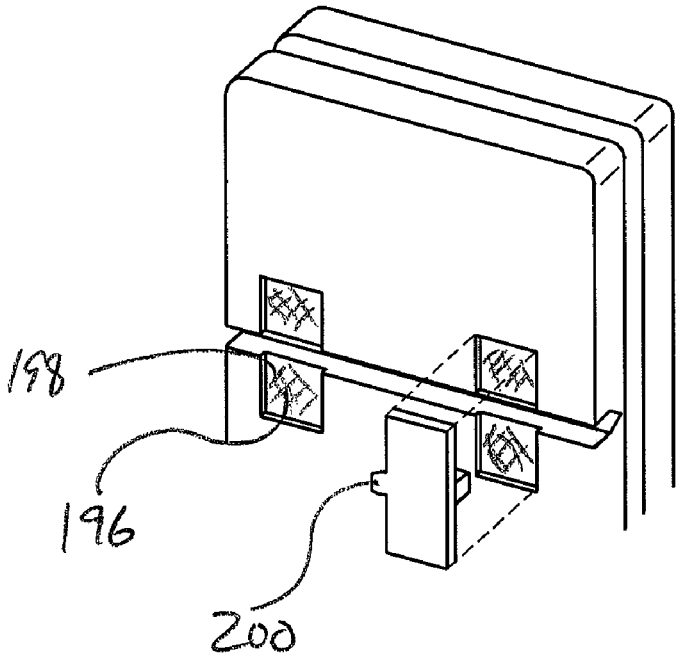
FIG. 24C is a perspective back view of a pad member showing an insert as in FIGS. 24A and B being fit into a cavity formed in the pad member.

With reference next to FIGS. 24A-C, another embodiment is provided in which a hook-and-loop fastener layer 192 is applied to a front surface 194 of the insert web member 182, and a complementary layer 196 of hook-and-loop fastener is applied to a back surface 198 of the pad member in the corresponding seat 190. As such, once applied, the insert 100 is held securely in place. In the illustrated embodiment, the web member of the insert comprises a tab 200 that is placed so as to be positioned over the corresponding cavity when the insert is in place. The tab 200 enables a user to pull the insert so as to disengage the hook-and-loop fasteners 192, 196 and remove the insert.

Although the illustrated embodiment discloses using a hook-and-loop fastener to hold the insert in place, it is to be understood that various methods and structures can be employed for releasably maintaining inserts of various sizes and shapes in place in cavities formed in a pad member. For example, Applicant envisions embodiments in which inserts are held in place by buttons, thongs, zippers, light adhesive, one or more detents, straps, a tight-fitting cover, an elastic cord, and/or any other suitable method or structure. And, in some embodiments, once a wearer determines which insert arrangement and flexibility characteristics are best for his style of play, the wearer may wish to permanently bond selected inserts in place in corresponding cavities, such as by applying an epoxy adhesive, staple, screw or the like.

Figure 25:
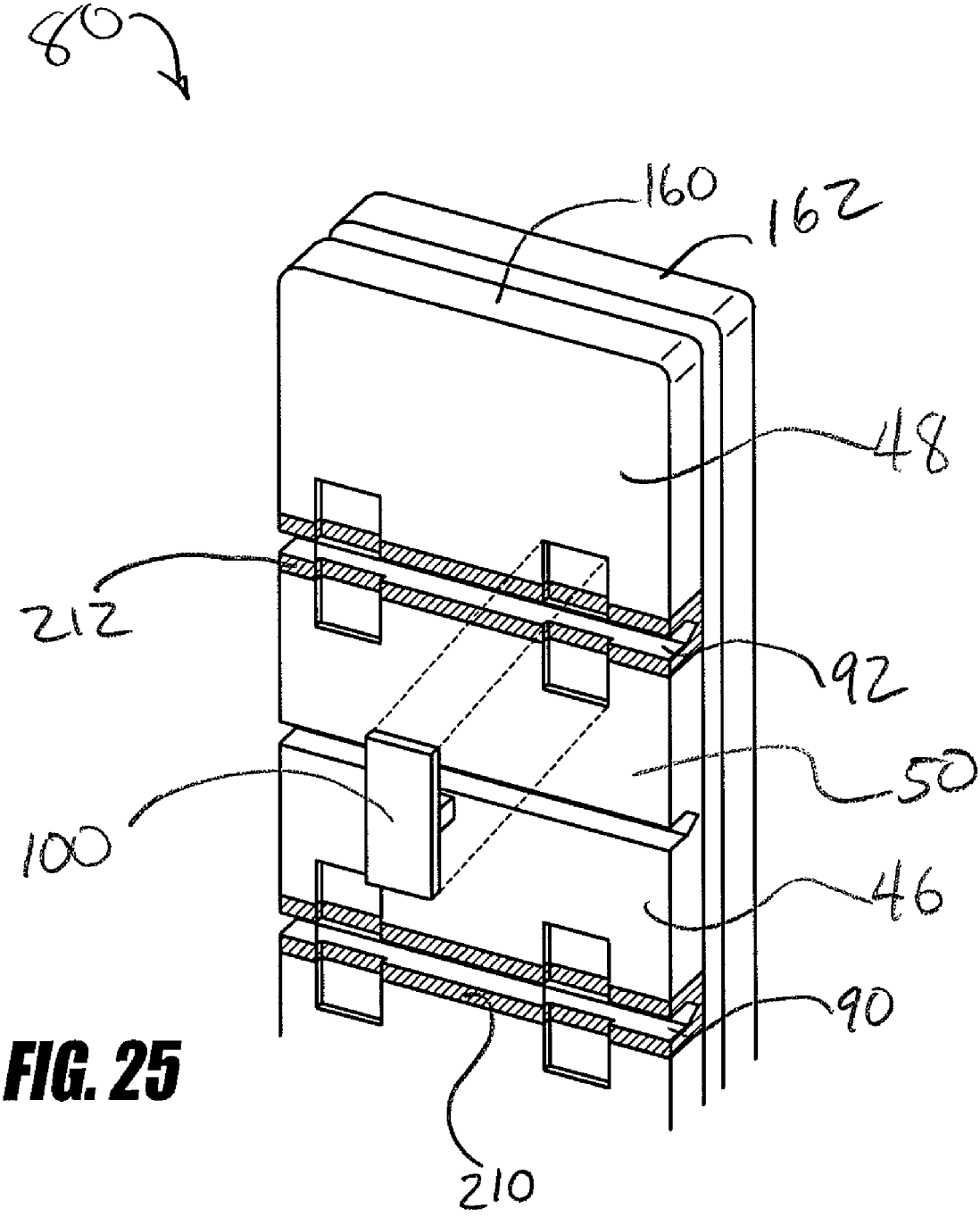
FIG. 25 is a perspective back view of another embodiment of a pad member having cavities formed in a portion of material that is more rigid than other portions of the pad member.

With reference next to FIG. 25, yet another embodiment of a pad member 80 is provided. In this embodiment, the pad member 80 includes a first and a second cavity liner 210, 212. As shown, the cavity liners 210, 212 are portions of the pad member 80 that are made of a different material than the adjoining padding segments of the pad member 80. In a preferred embodiment, the cavity liners 210, 212 are formed of a material that is more rigid than the other parts of the pad member. For example, in some embodiments the cavity liner 210, 212 is formed of a high density foam. In other embodiments it is formed of a hard plastic. Other suitable materials may include, for example, metals, composite materials, hardened resin, and the like. Such a hardened material facilitates efficient force transfer from the cavity to the block portion of an insert disposed in a seat without substantial deformation of the cavity liner. As such, forces that would tend to bend the pad member at the cavity 90, 92 will be transmitted to and resisted by the insert rather than being absorbed by crushing or bending of the pad member at or adjacent the insert.

In the embodiments described herein, the cavities extend across substantially the entire width of the corresponding pad member. It is to be understood that, in other embodiments, such cavities may extend only part way across the width of the corresponding pad member. Further, many of the cavity embodiments disclosed herein have resembled elongate, generally uniform slots or grooves. It is to be understood that various shapes for cavities may be employed, and the cavities may or may not be the major feature to define a hinge portion or flex zone.

Although the embodiments discussed herein are contemplated for use in connection with a hockey goaltender leg protective member, it is contemplated that inventive principles discussed herein can be used in other sporting pads, such as baseball catcher leg and/or chest protectors, lacrosse and football pads, other types of hockey pads such as back, shoulder and goalkeeper blocker pads, as well as pads for other sports and recreational activities. Further, inventive principles discussed herein can be used in conjunction with pads and padding systems employed in industrial applications.

Although certain preferred embodiments and examples have been disclosed, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A leg pad for a hockey goalkeeper, comprising:

(a) a pad member having a foot portion for at least partially covering the foot, a lower leg portion for at least partially covering the shin, a knee portion for at least partially covering the knee, an upper leg portion above the knee portion, a first padding segment, a second padding segment, a third padding segment, a first hinge portion defined between the first and second padding segments and extending transversely relative to the pad member, and a second hinge portion defined between the second and third padding segments and extending transversely relative to the pad member, the pad member being configured to flex at the first and second hinge portions so that the first and second padding segments pivot about the first hinge portion and the second and third padding segments pivot about the second hinge portion, the pad member further comprising a first cavity formed at the first hinge portion and extending transversely along the first hinge portion and a second cavity formed at the second hinge portion and extending transversely along the second hinge portion; and (b) first and second inserts being formed separately from the pad member and being sized and adapted to fit into the first and second cavities respectively;

wherein, in use, a hockey goalkeeper may selectively modify the flexibility of the pad member at the first and second hinge portions by selectively engaging or disengaging the first and second inserts into the first and second cavities respectively.

2. A leg pad as defined in claim 1, wherein one of the first and second inserts is sized and adapted to fit generally complementarily into the cavity.

3. A leg pad as defined in claim 1, wherein one of the first and second inserts is sized and adapted to be slightly larger than the cavity.

4. A leg pad as defined in claim 1, wherein one of the first and second inserts has a cross sectional shape that is substantially complementary to the cavity.

5. A leg pad as defined in claim 1, wherein the first insert has different flexibility characteristics than the second insert.

6. A leg pad as defined in claim 1, wherein the pad member has a width and each of the first and second hinge portions extends across the entire width.

7. A leg pad as defined in claim 1, wherein one of the first and second inserts comprises a block of foam that fits generally complementarily into the cavity.

8. A leg pad as defined in claim 1, wherein the pad member has a width and each of the first and second cavities extends across the entire width of the pad member and wherein each of the first and second inserts has a length substantially the same as a length of the cavity.

9. A leg pad as defined in claim 7, wherein one of the first and second inserts additionally comprises a web portion.

10. A leg pad as defined in claim 1, wherein one of the first and second inserts comprises a first portion having a first stiffness characteristic and a second portion having a second stiffness characteristic.

11. A leg pad as defined in claim 1, wherein one of the first and second inserts has a length substantially the same as a length of the cavity.

12. A leg pad as defined in claim wherein one of the first and second inserts has a length substantially less than a length of the cavity.

13. A leg pad as defined in claim 1, wherein the pad member comprises a padding segment and a cavity liner, the padding segment comprising a first material, the cavity liner comprising a second material, the second material being less compliant than the first material, and wherein each of the first and second cavities is formed in the cavity liner.

* * * * *